United States Patent [19]

Sandwall

[11] 4,245,942

[45] Jan. 20, 1981

[54] BULK CARGO SHIP HOLD ARRANGEMENT

[75] Inventor: Nils K. A. Sandwall, Lidingö, Sweden

[73] Assignee: AB Nordstroms Linbanor, Enkoping, Sweden

[21] Appl. No.: 946,074

[22] Filed: Sep. 26, 1978

[30] Foreign Application Priority Data

Oct. 5, 1977 [SE] Sweden ..... 77111474
Mar. 28, 1978 [SE] Sweden ..... 78034691

[51] Int. Cl.[3] ..... B60P 1/38
[52] U.S. Cl. ..... 414/144; 414/327
[58] Field of Search ..... 414/144, 327; 198/746, 198/748; 74/242.1 FP

[56] References Cited

U.S. PATENT DOCUMENTS

| | | | |
|---|---|---|---|
| 2,880,892 | 4/1959 | Wheeler | 414/327 |
| 3,414,144 | 12/1968 | Lassing | 414/144 |
| 3,946,619 | 3/1976 | Needles et al. | 74/242.1 FP |

FOREIGN PATENT DOCUMENTS

| | | | |
|---|---|---|---|
| 906940 | 8/1972 | Canada . | |
| 132631 | 7/1977 | Fed. Rep. of Germany | 198/748 |
| 1557651 | 2/1969 | France | 198/746 |
| 31268 | 6/1933 | Netherlands | 414/144 |
| 308889 | 2/1969 | Switzerland . | |
| 1292342 | 10/1972 | United Kingdom . | |

*Primary Examiner*—Stephen G. Kunin
*Assistant Examiner*—Terrance L. Siemens
*Attorney, Agent, or Firm*—Cushman, Darby & Cushman

[57] ABSTRACT

The invention relates to an arrangement in ship holds for bulk cargo, for example coal. The hold bottom has one or more rows of discharge openings and is substantially flat on at least one side of the rows of discharge openings. A plurality of drivers are arranged in succession on the flat bottom and are displaceable by drive motors in a direction transverse to said row so as to feed the cargo to the openings.

12 Claims, 5 Drawing Figures

BULK CARGO SHIP HOLD ARRANGEMENT

The present invention relates to an arrangement in ship holds for bulk cargo, for example, coal, one or more bulk cargo discharge conveyors being arranged beneath the bottom of the hold, the bottom being provided with a row of discharge openings for each conveyor, said row of openings being situated above the respective conveyor.

In so called self-discharging bulk cargo ships in which the bulk cargo is emptied down onto conveyor belts situated beneath the holds for further transportation to conveyors leading out from the ship, the bottom portion of the holds are usually provided with inverted V-shaped ridges extending in both the fore-and-aft and thwartships directions so that a plurality of V-shaped pockets are formed having outlet openings leading to the underlying conveyor belts. The purpose of this design is that the material will be able to be emptied completely through the various discharge points formed by the outlets merely by means of self-pouring. Each discharge point has an adjustable hatch by means of which the outflow to the underlying conveyor is regulated.

One disadvantage of this known construction is that the inverted V-shaped ridges must be relatively high in order that self-pouring of the material will be achieved during the final phase of unloading as well. Said ridges intrude upon the volume of the hold so that the effective cargo volume is restricted relative the hold in ships which do not self-discharge. It has also been found that 100% self-pouring cannot always be secured despite the V-shapted ridges. This is due to the fact that arch formation can sometimes arise in the material. Finally, another disadvantage is that this kind of a cargo ship is restricted to bulk cargos and cannot be used for transportation of general cargo or unit load cargos.

The purpose of the present invention is to achieve a ship hold arrangement of the kind disclosed above, by means of which the abovementioned disadvantages can be eliminated so that the hold volume can be increased, the risk for remaining arch formations is eliminated and the ship can be used for general cargo and unit load cargos.

This is achieved according to the invention by means of the hold bottom being substantially flat on at least one side of each row of discharge openings, in that a plurality of drivers are arranged in succession on the flat hold bottom along each row of discharge openings and in that the drivers are connected to a drive unit comprising resilient pulling means connected to the drivers, said pulling means extending in a direction transverse to the rows of discharge openings over at least a substantial portion of the hold bottom and being arranged to achieve controlled displacement of the drivers by means of pulling so that the drivers move in a direction transverse to the rows of discharge openings so as to feed the cargo to the openings.

A flat hold bottom designed in this manner can be placed deep down in the ship far below the level of the abovementioned ridges' upper edge so that maximum cargo space is obtained. Furthermore, the possibility of alternatively loading general cargo and unit load cargos is created by means of the flat bottom. Total emptying of the hold is secured by means of the drivers which move in the thwartships direction, said drivers being pulled along the hold bottom through the material when it ceases to self-pour and tends to hang.

It has been found that feed capacity is increased and function is improved if the hold bottom is arched in the direction of movement of the drivers.

It has also been found that functional security is further increased if the drivers have such inclined drive surfaces that, during the feeding movement, the cargo loads the drivers with a force having a component directed against the hold bottom. Preferably, the drivers can have a trapezoidal cross-section.

In a preferred embodiment of the arrangement according to the invention, said arrangement having a drive unit in the form of a chain for each driver, means for prestressing the chain are arranged. This contributes considerably to improving the function.

The invention is described in more detail below. Reference is made to the enclosed drawings showing embodiments.

Figure 4:
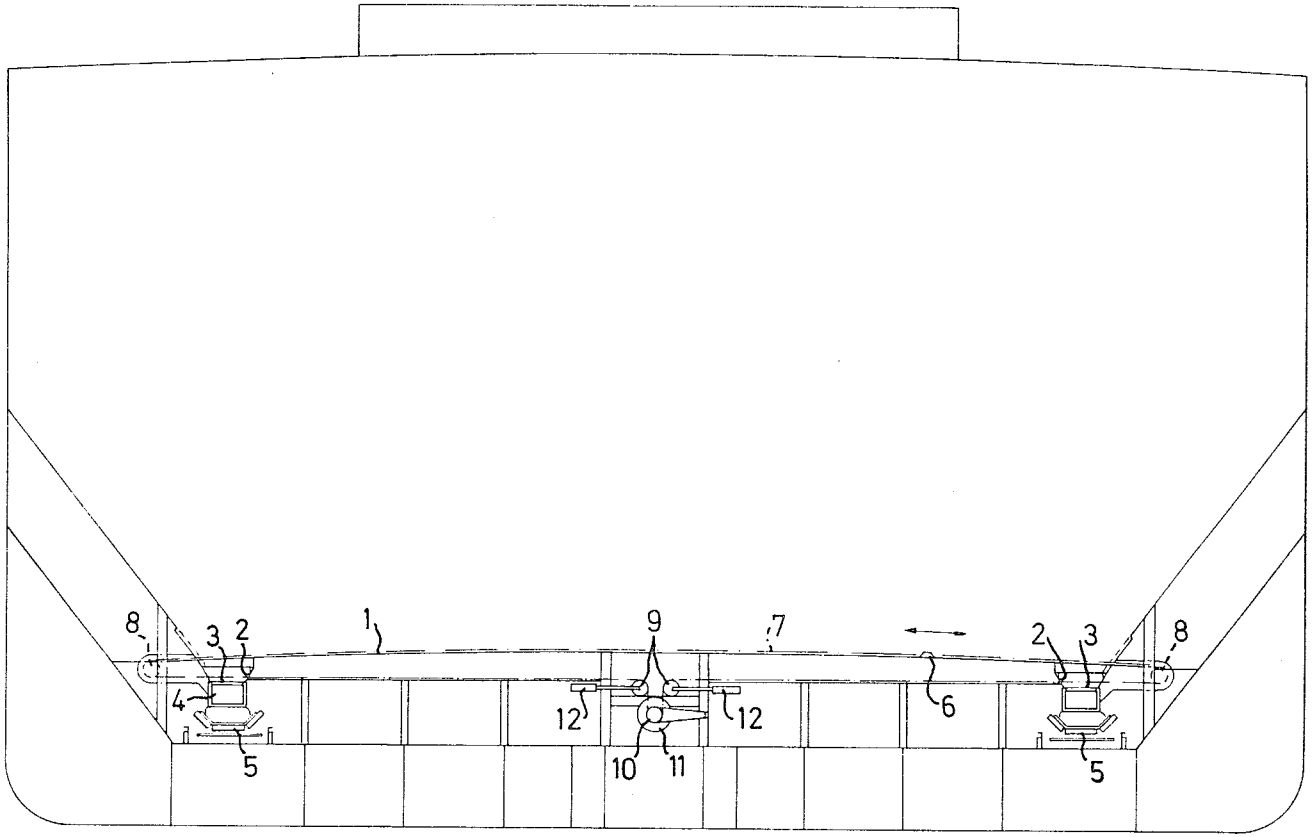

FIG. 4 a cross-section of a ship hold having another embodiment of the invention.

Figure 5:
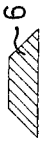

FIG. 5 is a cross-section of a driver.

Figure 1:
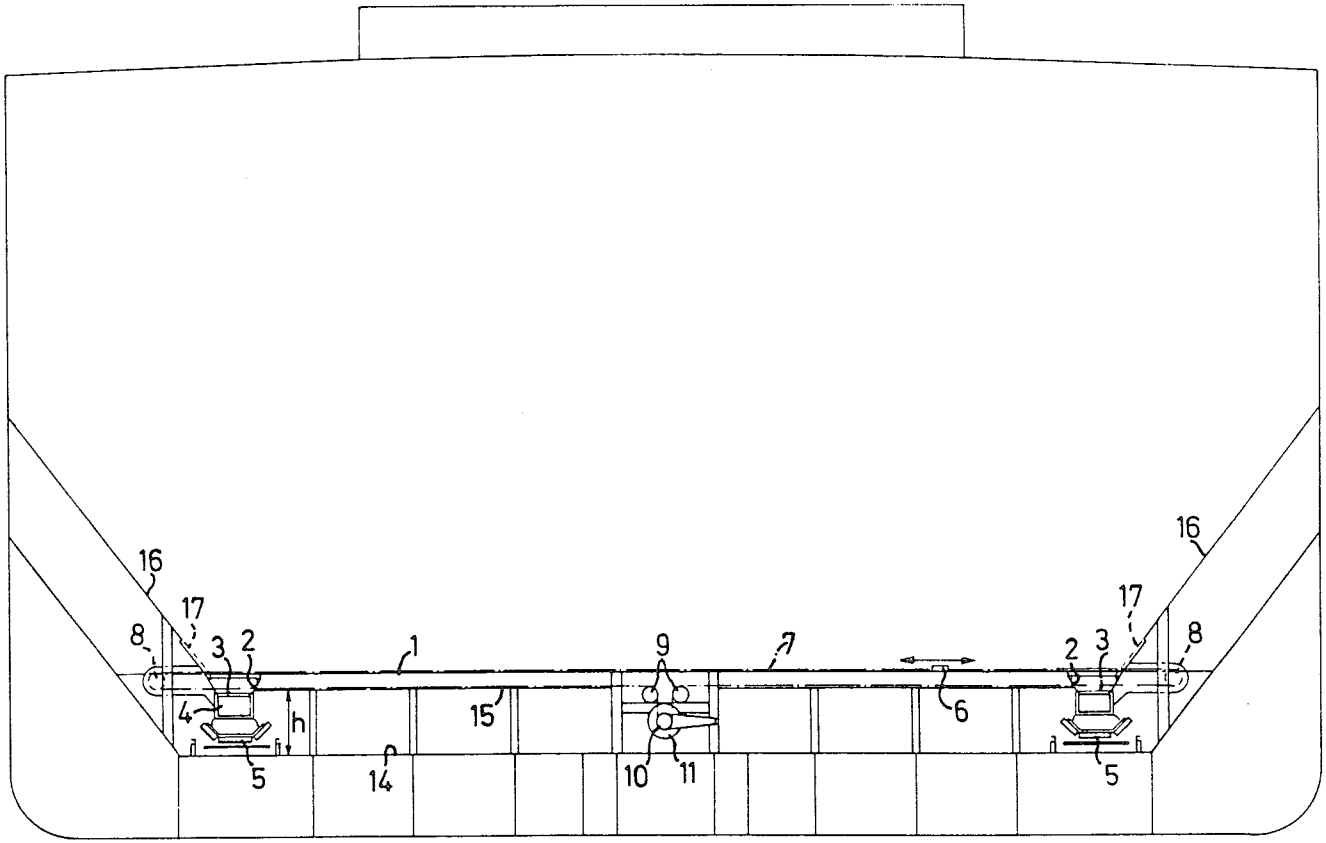
FIG. 1 is a schematic cross-section of a ship hold having an arrangement according to the invention.
Figure 2:
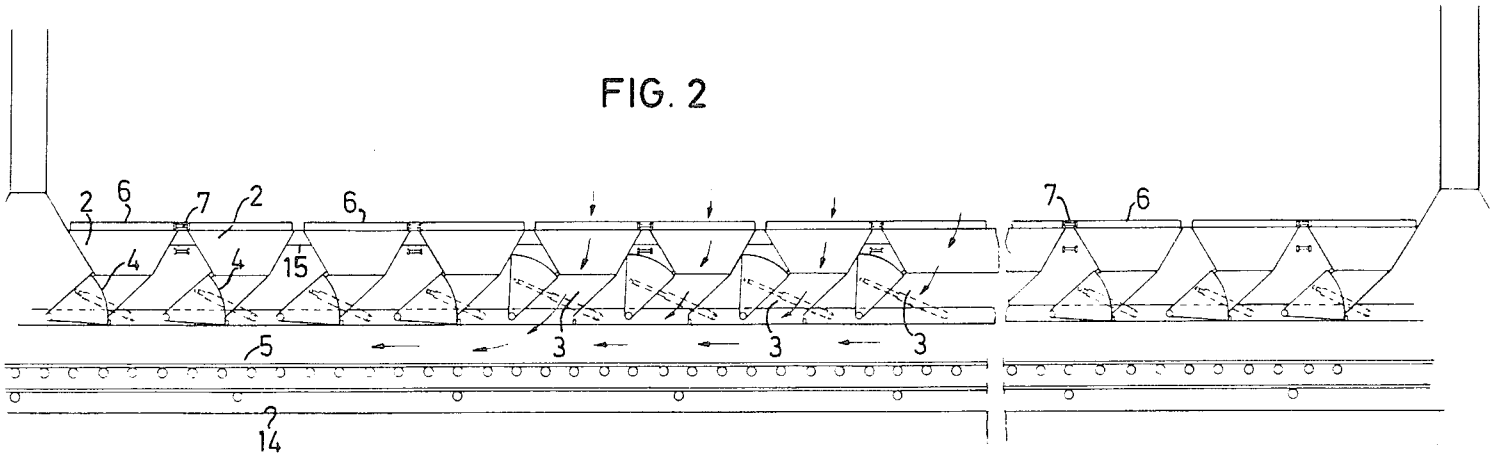
FIG. 2 is a schematic longitudinal section of the ship hold in FIG. 1.

A hold in a coal freighter having an arrangement according to the present invention is shown schematically in FIGS. 1 and 2. The hold has a flat bottom 1 between two rows of discharge pockets 2 having outlet openings 3 and hatches 4, said rows extending in the fore-and-aft direction at the outer edges of the hold. A conveyor belt 5 runs beneath each row of discharge pockets 2, said belt extending in a conventional manner beneath all of the holds of the ship and upon which material released through the openings 3 down onto the conveyor is fed to a conveyor (not shown here) leading out from the ship.

A plurality of rod-shaped drivers 6 rest upon the flat hold bottom 1. Each of the drivers 6 is coupled to a respective chain 7 (c.f. FIG. 1). The chain 7 extends across the hold bottom 1 to guide wheels 8 situated outside of each longitudinal side, further via said guide wheels 8 under the hold bottom to guide wheels 9 and a drive wheel 10 on a drive motor 11 which can be a hydraulic motor or an electric motor having a gear. By means of the guide wheels 9, the angle of contact of the chain on the drive wheel 10 will be approx. 180°. Thus, with the help of an accompanying chain 7, each driver 6 can be driven individually across the flat bottom between the rows of discharge pockets 2. As is shown in FIG. 2, the drivers 6 are arranged with relatively slight mutual distance in the fore-and-aft direction. Thus, when all of the drivers are driven, just about the entire bottom surface between the rows of discharge pockets 2 can be scraped.

Unloading is carried out in such a manner that the required number of hatches (see FIG. 2) are first opened in a conventional manner so that the desired feeding capacity is obtained by means of self-pouring. Further hatches are opened thereafter until all of the hatches 4 are open. When self-pouring ceases, the required number of drivers 6 are activated. They are drawn a number of times across the hold bottom 1 between the rows of discharge pockets 2 until all the material within their operating area has been fed out. Further drivers 6 are activated thereafter and unloading continues until the entire ship has been emptied. The different drivers can be moved, arbitrarily as required, entire "strokes" between the conveyors and/or shorter "strokes" to one of the conveyors.

Figure 3:
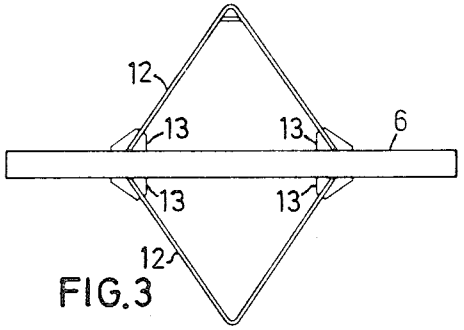
FIG. 3 is a detail view of a driver as seen from above.

FIG. 3 illustrates in more detail an embodiment of a driver 6. It consists of a beam having a rectangular cross-section, the broader side of which rests upon the hold bottom 1. Angularly bent stays 12 are welded onto the opposite short sides with the help of plates 13. The ends of the drive chain 7 are intended to be connected to said stays 12. By arranging the stays 12 in this manner, it is possible to drive each driver 6 in the transverse direction by means of a single chain without any risk of the driver being misadjusted. The driver 6 becomes "self-adjusting".

As all of the drivers 6 can be driven individually by their own drive motors 11, for example, hydraulic motors, several of which can have a common pump, one obtains a very flexible system which allows for effective unloading while maintaining correct trimming of the ship during the entire unloading process. Should a single driver "fall out", this has no effect on the other drivers and, thus, is of minor importance. The number of drivers and their size depends on the size of the ship. An embodiment of the invention in a coal freighter of 120,000 tons, for example, has 50 drivers having a length of three meters, a width of 200 mm and a height of 100 mm. The small height is to be essentially noticed as it provides an effective discharge without requiring unreasonably heavy machinery.

By means of the invention, the volume of the ship is put to optimum use as cargo volume. The distance between the ship's so called tank top 14 and the bottom side 15 of the hold bottom 1 (denoted h in FIG. 1) need only correspond to normal standing height.

In order that the bottom area of the entire hold, i.e. the area of the discharge pockets 2 as well, shall be able to be used for general cargo, the side walls 16 of the hold can be provided with hatches as indicated by 17, which can be swung down over the discharge pockets 2 so as to form an extension of the flat hold bottom 1 out to the sides 16.

In FIG. 4 a plurality of rod-shaped drivers 6 having a trapezoidal cross-section rest upon an arched hold bottom 1. The guide wheels 9 are journalled in a horizontally movable fashion and are each connected to a respective hydraulic cylinder 12 by means of which the tension of the chain can be controlled. Thus, with the help of an accompanying chain 7, each driver 6 can be driven individually across the bottom between the rows of discharge pockets 2 in the same manner as previously described.

What I claim is :

1. An arrangement in ship holds for bulk cargo, for example, coal, at least one bulk cargo discharge conveyor being arranged beneath the bottom of the hold, the bottom being provided with a row of discharge openings for said conveyor, said row of openings being situated above the conveyor, characterized in that the hold bottom is substantially flat on at least one side of the row of discharge openings, in that a plurality of rod-shaped driver elements are arranged in succession on the flat hold bottom along the row of discharge openings and in that the driver elements are connected to drive means comprising individual resilient pulling means connected to each driver element, said pulling means extending in a direction transverse to the row of discharge openings over at least a substantial portion of the hold bottom and being arranged to achieve controlled displacement of the drivers by means of pulling so that the driver elements move in a direction transverse to the row of discharge openings so as to feed the cargo to the openings.

2. Arrangement according to claim 1, characterized in that the driver elements are transversely spaced apart so that they can sweep together over substantially the entire flat bottom surface.

3. Arrangement according to claim 1 or 2, characterized in that each driver element comprises a transversely-movable rod-shaped element, the height of which is 1/30th of its length.

4. Arrangement according to claim 1 wherein there are a plurality of spaced-apart rows of discharge openings and wherein there are a plurality of said driver elements associated with each row, and wherein there is a separate drive means for the driver elements associated with each row.

5. Arrangement according to claim 4, characterized in that each drive means comprises a chain which is connected to the respective driver elements, said chain extending across the rows of discharge openings along the upper and lower sides of the flat hold bottom and a drive motor for said chain.

6. Arrangement according to claim 5, characterized in that the driver elements are connected to the respective chain by stays which are rigidly connected to said driver elements and project transversely from the driver elements.

7. Arrangement according to claim 4 wherein a discharge conveyor with an accompanying row of discharge openings is arranged at each longitudinal outer side of the hold, wherein the hold bottom between said rows of discharge openings is flat, and wherein the driver elements are reciprocally movable at least a portion of the distance between the rows.

8. Arrangement according to claim 1, characterized in that the hold bottom is arched in the transverse direction.

9. Arrangement according to claim 8, in which the drive means includes a chain, and means for pre-stressing the chain.

10. Arrangement according to claim 1, characterized in that the driver elements have such inclined driver surfaces that the cargo, during the feed movement, loads the driver elements with a force having a component directed against the hold bottom.

11. Arrangement according to claim 10, characterized in that the driver elements are rod-shaped members having a trapezoidal cross-section.

12. An arrangement in ship holds for bulk cargo comprising: a plurality of rows of discharge openings extending longitudinally of the hold, said rows being spaced apart in a transverse direction; an endless conveyor arranged beneath each row of openings and beneath the bottom of the hold for receiving cargo from the respective openings; a group of elongated driver elements slidably arranged on the upper surface of the bottom of the hold at the location of each row of openings, said driver elements extending longitudinally of the hold; separate driver means for each group of driver elements, each drive means including a driven endless member to which the respective driver elements are attached, each endless member extending transversely of the hold so as to move the respective driver elements transversely to thereby feed the cargo to said discharge openings.

* * * * *